United States Patent [19]

Booty

[11] 4,003,618

[45] Jan. 18, 1977

[54] MULTIPLE SOCKET STRIP

[76] Inventor: Donald J. Booty, 513 Durham Drive, Frankfort, Ill. 60423

[22] Filed: Aug. 14, 1975

[21] Appl. No.: 604,585

[52] U.S. Cl. ..... 339/22 R; 339/88 R; 339/188 R

[51] Int. Cl.[2] ..... H01R 13/46; H01R 33/46

[58] Field of Search ..... 339/17 D, 19, 20–24, 339/88, 188, 189

[56] References Cited

UNITED STATES PATENTS

| | | | |
|---|---|---|---|
| 2,269,779 | 1/1942 | Morten | 339/22 R |
| 2,351,631 | 6/1944 | O'Brien | 339/22 R |
| 2,361,537 | 10/1944 | Frank | 339/21 R |
| 2,977,566 | 3/1961 | Neumann | 339/20 |
| D131,024 | 1/1942 | O'Brien | 339/23 |

FOREIGN PATENTS OR APPLICATIONS

| | | | |
|---|---|---|---|
| 2,016,334 | 10/1971 | Germany | 339/22 R |
| 517,318 | 1/1940 | United Kingdom | 339/23 |

*Primary Examiner*—Lake Roy
*Assistant Examiner*—Neil Abrams
*Attorney, Agent, or Firm*—Seidel, Gonda & Goldhammer

[57] ABSTRACT

The multiple socket strip includes an elongated body having a plurality of socket holes at spaced points therealong with each hole being adapted to receive a removable plug. The plug is rotated about its longitudinal axis to make electrical contact between J-shaped conductors of the plug with spaced elongated conductors concealed in said body.

14 Claims, 7 Drawing Figures

FIG. 5
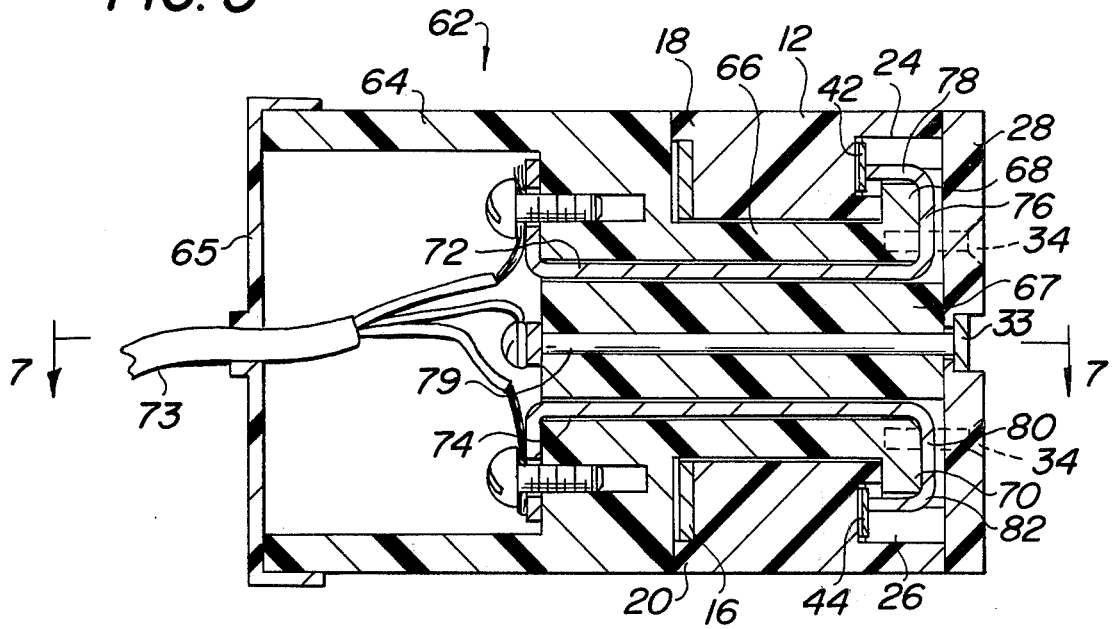
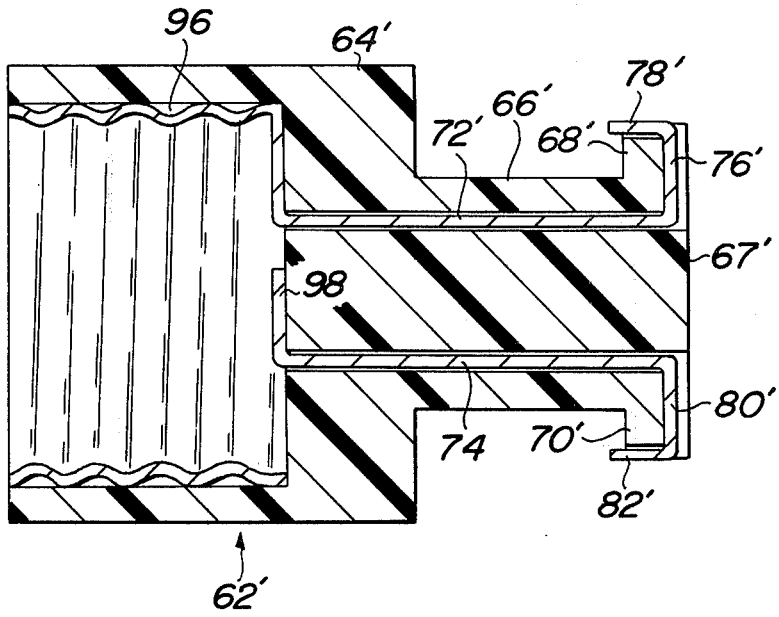
FIG. 6

MULTIPLE SOCKET STRIP

BACKGROUND

Prior art devices are exemplified by U.S. Pat. Nos. 1,932,746 and 2,636,950. The prior art devices are objectionable from a large number of viewpoints including assembly, maintenance, safety, etc. In connection with safety, many prior art devices have conductors which are exposed through the socket holes so that a screwdriver, safety pin or the like can be extended through the socket hole and contact the conductor.

Other disadvantages of the prior art involve using the plug contacts to effect the only mechanical coupling between a plug and the socket strip. Prior art devices have been unattractive and are comprised of a large number of components which unnecessarily complicates assembly and maintenance. The socket strip of the present invention overcomes the above disadvantages in the prior art while having other advantages as will be made clear hereinafter.

The multiple socket strip of the present invention is comprised of an elongated body having a plurality of socket holes extending from front to back at spaced locations along said body. The back of said body has two longitudinally extending spaced slots or notches. Each slot or notch receives an elongated conductor. The elongated conductors extend along opposite sides of the holes. Each hole communicates with each slot.

A rear cover is provided for the body. The rear cover overlies the back of the body to conceal the elongated conductors in the slots or notches and to close off the socket holes. A means is provided on the body for coupling of an electrical potential to the elongated conductors. Hence, a plug may be inserted into any one of all of said socket holes to be electrically coupled to said conductors after rotation in the plug about its axis.

In a preferred embodiment of the present invention, the elongated body is made from a material which is electrically nonconductive. The body is preferably cast from a polymer plastic material with the conductive slots and socket holes being formed at the same time thereby minimizing machining or other labor in connection with producing the body. Likewise, in a preferred embodiment, the back cover is cast or extruded from polymer plastic. The front of the strip is preferably provided with a decorative surface. The decorative surface may be attained by a separate inlay layer or coating.

It is an object of the present invention to provide a novel multiple socket strip constructed of a minimum number of parts for ease in assembly and maintenance.

It is another object of the present invention to provide a multiple socket strip which provides inaccessibility of conductors for purposes of safety while being accomplished in a manner which is simple and inexpensive.

It is another object of the present invention to provide an undulating support surface for the elongated conductors in the body to thereby maximize reliability of attaining electrical contact.

Other objects will appear hereinafter.

For the purpose of illustrating the invention, there is shown in the drawings a form which is presently preferred; it being understood, however, that this invention is not limited to the precise arrangements and instrumentalities shown.

FIG. 5 is a view taken along the line 5—5 in FIG. 1.

FIG. 6 is a sectional view through another type of plug which may be used with the strip of the present invention.

Referring to the drawing in detail, wherein like numerals indicate like elements, there is shown in FIG. 1 a portion of a multiple socket strip in accordance with the present invention designated generally as 10.

Figure 2:
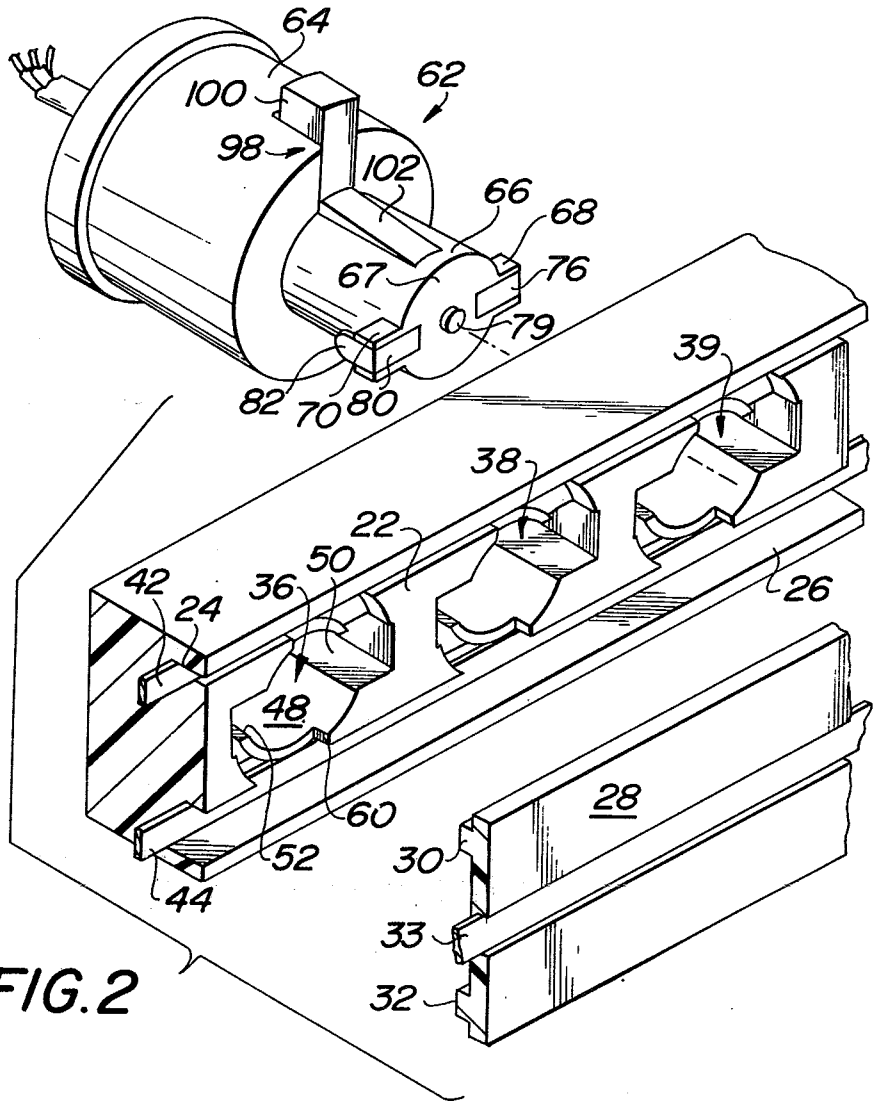
FIG. 2 is a partial exploded view of a strip in accordance with the present invention and a plug to be coupled thereto.

The multiple socket strip 10 includes an elongated body 12 having ends 13 and 15. The body 12 is preferably molded or cast from a polymer plastic material with the slots, sockets, etc. to be described hereinafter. The body 12 has a front face 14 and a rear face 22. The front face 14 is preferably rendered decorative such as by adhesively bonding thereto a decorative strip 16.

The front face is also provided with projections 18 and 20. The projections 18 and 20 preferably extend for the entire length of the strip 10 along the upper and lower edges of the front face. The projections 18 and 20 prevent the decorative strip 16 from being marred whenever a plug is inserted into a socket hole. When the plug to be used with the strip 10 has a diameter which is less than the width of the strip 10, a single longitudinally extending projection may be utilized in place of the projections 18 and 20.

The rear face 22 of the body 12 is provided with longitudinally extending grooves, slots or notches 24, 26. See FIGS. 2 and 3. As will be apparent from FIG. 3, the length of the grooves 24, 26 is slightly less than the length of the body 12 so that a land portion on the body 12 exists between each end of the groove and the ends 13, 15 of the body 12.

A rear cover 28 is provided. The cover 28 overlies the rear face 22 on the body 12. Cover 28 has a row of projections 30 at an elevation so that the projections 30 may enter the groove 24. Cover 28 also has a row of projections 32 at an elevation so that the projections 32 may enter the groove 26. A groove on the rear face of cover 28 contains grounding strip 33. Cover 28 may be molded or cast from a polymer plastic material with the rows of projections 30, 32. Alternatively, the cover 28 may be extruded from a polymer plastic material and subsequently machined so as to remove portions of the ribs to thereby define the spaced projections 30, 32. See the arrangement of projections 30 in FIG. 4.

The body 12 is provided with a series of socket holes 36, 38, 39, 40 and 41. A larger number of holes are provided as compared with the number illustrated in the drawing. The number of holes provided in the strip 10 depends upon the length of the strip 10. For example, if strip 10 has a length of five feet, approximately thirty-eight socket holes located one and one-half inches on center may be provided.

The socket holes 36–41 extend from the front face 14 to the rear face 22. The diameter of the socket holes 36–41 is less than the transverse dimension between the grooves 24, 26. See FIGS. 3 and 5.

Figure 3:
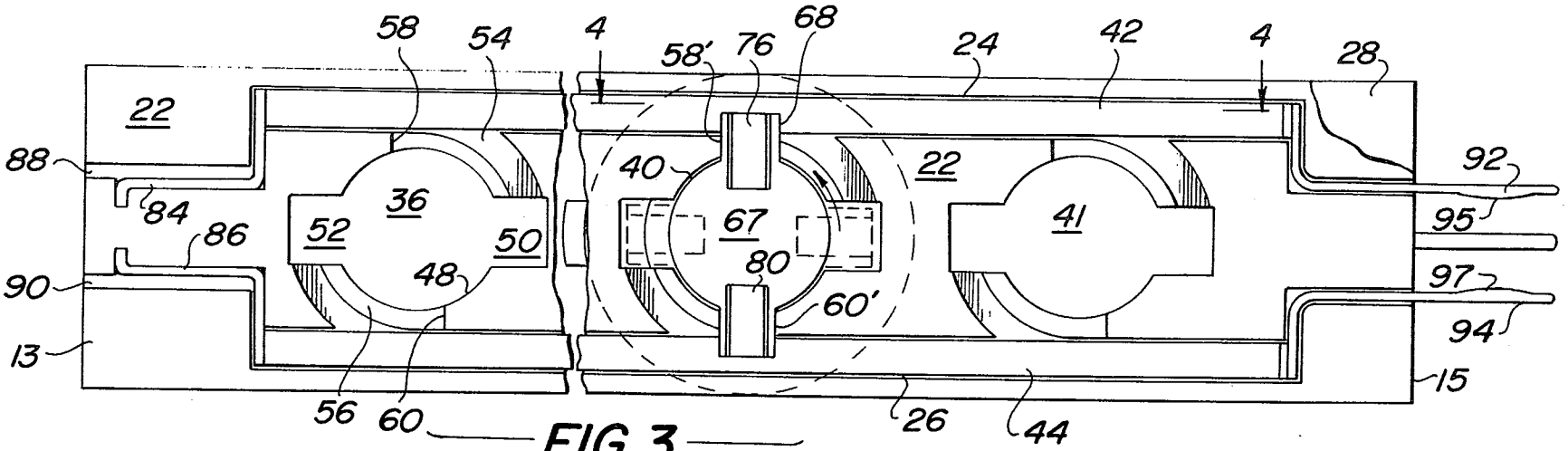
FIG. 3 is a rear elevation view of the strip with the rear cover being broken away for purposes of illustration.

An elongated strip conductor 42 is disposed within the groove 24. An elongated strip conductor 44 is disposed within the groove 26. Referring to FIG. 3, it will be noted that the material of the body 12 is removed in certain areas so as to provide communication between the socket holes and the grooves 24, 26. Referring to socket hole 36, it is circular with radially outwardly extending diametrically opposite keyways 50 and 52 contiguous therewith. From the keyway 50, the body 12 is provided with a channel 54 from the 12 o'clock position to the 3 o'clock position as seen in FIG. 3. Also, the body 12 is provided with a channel 56 extending from the 6 o'clock position to the 9 o'clock position as seen in FIG. 3. The channels 54, 56 result in the provision of a limit stop 58 and a limit stop 60. The limit stops 58 and 60 are on opposite sides of the longitudinal axis of the hole 36.

One type of plug which may be used with the strip 10 is designated generally as 62. The plug 62 facilitates coupling a remotely located lamp, motor, tool, or other load to the conductors 42, 44 of the strip 10. The plug 62 is provided with an electrically non-conductive body 64 and cover 65. Body 64 has an axial extension 66 at the end thereof remote from the cover 65. Extension 66 terminates in an end face 67. See FIGS. 2 and 5.

The extension 66 is provided with diametrically opposite, radially outwardly extending keys 68, 70. As shown more clearly in FIG. 5, a conductor 72 extends longitudinally of the extension 66. Conductor 72 has a radially outwardly directed portion 76 and a terminal portion 78. Portions 76 and 78 are supported by the key 68. The terminal portion 78 has a rounded tip and extends toward the front face 14 for contact with the strip conductor 42.

Conductor 74 extends longitudinally through the extension 66. Conductor 74 has a radially outwardly extending portion 80 and a terminal portion 82. Terminal portion 82 has a rounded tip and extends toward the front face 14. Each of the portions 76, 80 overlie the end face 67. Portions 80 and 82 are supported by the key 70. Each of the portions 78 and 82 are narrower than the respective key associated therewith. See FIG. 2. The tip of terminal portion 82 is adapted to contact the strip conductor 44. Plug 62 has a grounding pin 79 adapted to contact grounding strip 33 through a hole in cover 28.

Figure 1:
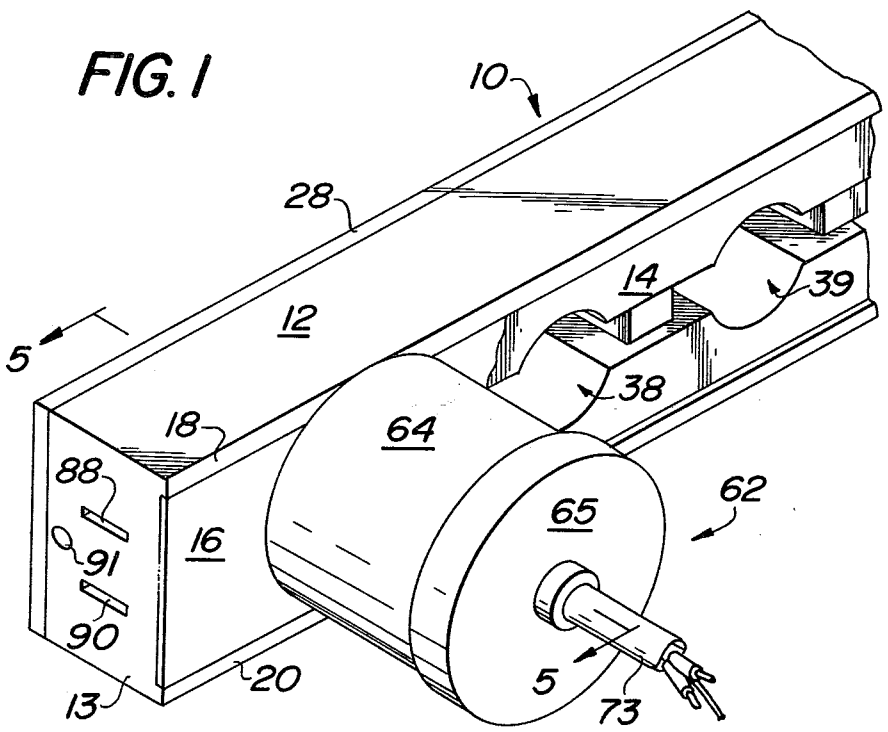
FIG. 1 is a partial perspective view showing one end of a strip in accordance with the present invention.

Referring to FIG. 3, the strip conductor 42 is provided with a flat contact 84 adjacent the end 13 of the body 12. The strip conductor 44 is provided with a similar contact 86. Body 12 is provided with longitudinally extending slots 88 and 90. See FIG. 1. Slot 88 is aligned with a surface of contact 84 while slot 90 is aligned with a surface of contact 86. Body 12 has a hole 91 adapted to receive a grounding contact for engagement with grounding strip 33.

Referring to the righthand end of FIG. 3, the strip conductor 42 is provided with a prong 92 which extends in an axial direction from the end 15 of the body 12. Strip conductor strip 44 is provided with a similar prong 94. The juxtaposed surface of the prongs 92 and 94 are provided with a bump respectively designated as 95 and 97. Each strip 10 may be electrically coupled in series with another strip. Bump 95 on prong 92 is adapted to enter slot 88 of another strip and engage contact 84 thereof. Likewise, bump 97 on prong 94 is adapted to enter slot 90 on another strip and engage contact 86 thereof.

Figure 7:
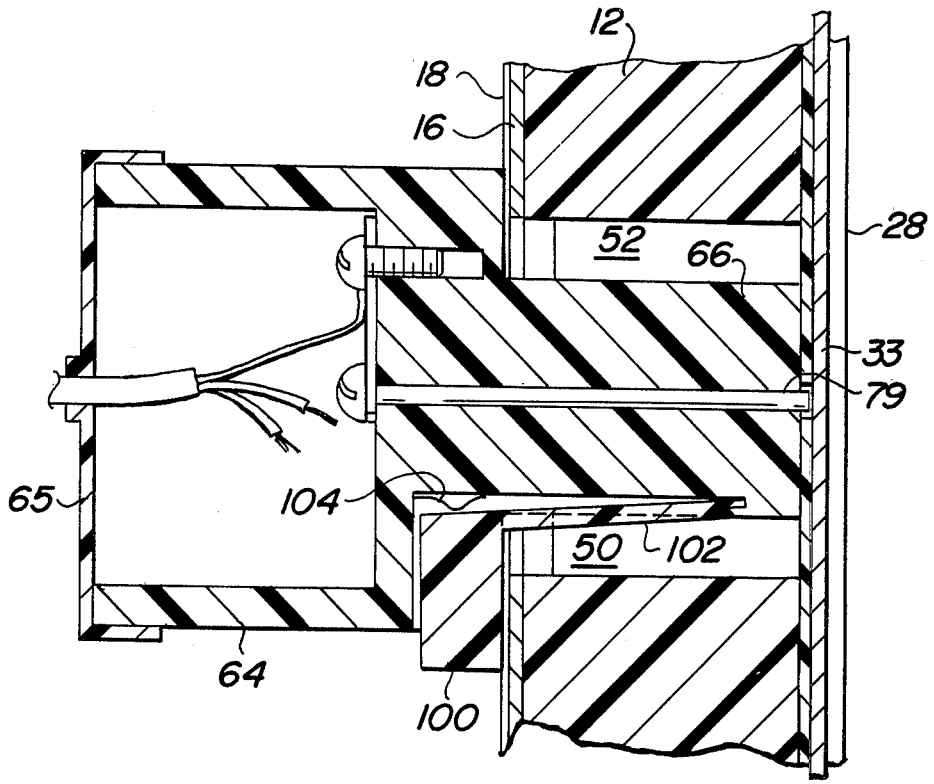
FIG. 7 is a sectional view taken along the line 7—7 in FIG. 5.

A locking clip 98 is provided on plug 62 to lock the plug 62 to body 12 in an operative position wherein terminal portions 78, 82 contact conductors 42, 44 respectively. Clip 98 includes a tab 100 on the periphery of body 64 and a latch portion 102 recessed in a groove on the periphery of extension 66. A spring 104 biases clip 98 radially outwardly. Latch portion 102 has a width slightly less than the height of the keyways 50, 52. When plug 62 is inserted in a socket hole, clip 98 is at the 12 o'clock position and tab 100 is depressed by one's finger. When the limit stops 58, 60 are contacted, clip 98 is opposite the keyway 50. When tab 100 is released, latch portion 102 is biased to a location partially disposed in keyway 50. See FIG. 7.

In FIG. 6, there is illustrated another embodiment of the plug capable of being used with the strip 10. The plug is designated generally as 62' and is identical with plug 62 except as will be made clear hereinafter. Hence, corresponding elements are provided with corresponding primed numerals.

The plug 62' facilitates the use of a lamp connected directly thereto for purpose of illumination. The body 64' is provided with a threaded socket 96 connected to the conductor 72'. A centrally disposed contact 98 is connected to the conductor 74'. A lamp may be threaded into the socket 96 and will engage the contact 98. The plug 62' is otherwise identical with the plug 62.

To facilitate reliability of contact between the terminal portions 78, 82 and their associated strip conductors 42, 44, the bottom surface of the grooves 24, 26 is an undulating surface. See FIG. 4 wherein the bottom surface of the groove 24 is provided with depressions 46 at spaced points therealong. Each depression is provided generally in the area of one of the socket holes 36–41. The rear cover 28 is releasably connected to the body 12 in any convenient manner such as by threaded fasteners 34.

An electrical coupling of terminal portions 78, 82 of plug 62 is attained as follows. Let it be assumed that it is desired to connect the plug 62 to the strip 10 at socket hole 36. Projection 66 is inserted into the hole 36. The keyways 50, 52 accommodate the keys 68, 70 and their associated terminal portions of the conductors 72, 74. When the extension 66 has completely entered the hole 36, the end face of the body 64 will contact the projections 18 and 20. See FIG. 5. Thereafter, the plug 62 is rotated 90°. The channels 54, 56 facilitate such rotation.

When the plug 62 has been rotated 90°, key 68 will engage limit stop 58 and key 70 will engage limit stop 60. At the same time, the rounded tip of terminal portion 78 engages strip conductor 42 and the rounded tip of terminal portion 82 engages the strip conductor 44. Such engagement depresses each strip conductor 42, 44 into the juxtaposed depression 46. Plug 62 is now locked to body 12. See FIGS. 5 and 7.

Since key 68 has a radially disposed face which contacts the area of the body 12 between hole 36 and the slot 24 while key 70 has a similar face which contacts the area of the body 12 between hole 36 and slot 26, the plug 62 is mechanically supported by body 12. Hence, the plug 62 is supported by body 12 independently of the electrical coupling whereby the body 12 can be attached to a ceiling with plug 62 suspended therefrom.

Figure 4:
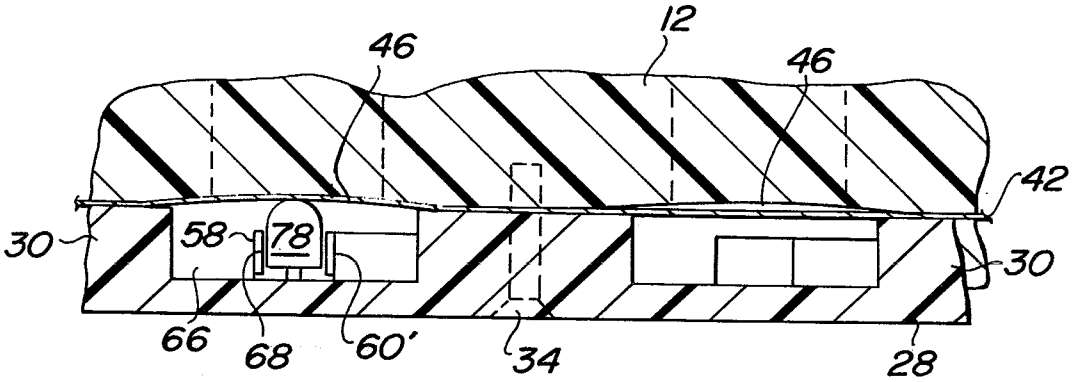
FIG. 4 is a view taken along the line 4—4 in FIG. 3.

In FIGS. 3 and 4, plug 62 has been inserted into socket hole 40. Note that terminal portion 78 flexed strip conductor 42 into depression 46 and that the keys are against limit stops 58' and 60'. As shown in FIG. 4, the projections 30 securely hold the strip conductor 42 against the bottom of groove 24 between adjacent socket holes.

Thus, there is provided a multiple socket strip 10 capable of having its prongs 92, 94 plugged into a conventional electrical receptacle or into another multiple socket strip 10. Plugs 62, 62' may be introduced into any one of the holes 36–41. The strip 10 can rendered decorative on its front face by layer 16 which is not marred due to rotation of plugs 62, 62'.

Reliability of contact is attained due to the depressions 46 and the rounded tip on the terminal portions 78, 82. A safety feature is provided by the area of the strip conductors 42, 44 which are not visible from the front face of strip 10. The strip 10 is made from a minimum number of components with minimum machining being required and assembly time being at a minimum.

Strip 10 may be part of a floor lamp. Strip 10 may be mounted in a vertical or horizontal position by means of fasteners not shown. Fasteners for mounting strip 10 to a support may be screws which extend through predrilled holes (not shown) located between two adjacent socket holes. Body 12 and cover 28 may be made from pigmented plastic, such as polystyrene, of the same or contrasting colors.

The present invention may be embodied in other specific forms without departing from the spirit or essential attributes thereof and, accordingly, reference should be made to the appended claims, rather than to the foregoing specification as indicating the scope of the invention.

I claim:

1. A multiple socket strip comprising an elongated body having a plurality of discrete socket holes extending from front to back at spaced locations therealong, first and second spaced elongated conductors, the back of said body having spaced grooves each containing one of said conductors, said grooves being on opposite sides of said holes and spaced therefrom, said body having two channels providing communication between each groove and each hole, a rear cover overlying said back of said body to conceal said elongated conductors and to close off the back end of said holes, means on said body for coupling an electrical potential to said elongated conductors, whereby a plug may be inserted into said holes and can be electrically coupled to said conductors after rotation of the plug about its longitudinal axis.

2. A multiple socket strip in accordance with claim 1 wherein said elongated conductors are flat elongated conductors lying parallel to the front of said body and generally perpendicular to the longitudinal axes of said holes.

3. A multiple socket strip in accordance with claim 1 wherein said holes are rounded with keyways contiguous thereto and at diametrically opposite portions of the holes, and said channels extend from each of said keyways to a limit stop adjacent each of said grooves.

4. A multiple socket strip in accordance with claim 1 wherein said grooves are provided with discrete depressions juxtaposed to said elongated conductors at spaced points therealong, each depression being generally located adjacent a socket hole and being adapted to receive said conductors when pressure is applied to the conductors in the area of the depressions.

5. A multiple socket strip in accordance with claim 1 wherein said means on said body for coupling electrical potential to said elongated conductors includes contacts at one end of said body, and said body having prongs extending from the opposite end of the body, each prong being electrically coupled to one of said elongated conductors.

6. A multiple socket strip in accordance with claim 1 wherein said body and rear cover are made of polymer plastic material, said rear cover having discrete projections extending into each of said grooves at locations between adjacent holes to secure the conductors contained within said grooves.

7. A multiple socket strip comprising an elongated body of a dielectric material, said body having a plurality of discrete socket holes at spaced points therealong, each socket hole having diametrically opposite keyways contiguous therewith so that the socket hole may receive a plug having diametrically opposite keys, said body having a pair of grooves on opposite sides of said holes, each hole communicating with each groove, elongated strip conductors, each conductor being disposed within one of said grooves, and means defining a rear cover which extends into each groove at locations between adjacent holes to secure the conductors disposed within said grooves.

8. A multiple socket strip in accordance with claim 7 wherein said rear cover means includes a cover which closes one end of said holes and said body having depressions juxtaposed to said conductors at spaced points therealong, each depression being adjacent one of said holes and being adapted to receive said conductors when pressure is applied to the conductors in the area of the depressions.

9. A multiple socket strip in accordance with claim 8 wherein said body is molded of polymer plastic, a front face of said body having at least one raised projection and a decorative surface, said projection preventing a plug from marring said surface when a plug is inserted into a socket hole and rotated about the axis of the hole.

10. A multiple socket strip in accordance with claim 9 including a pair of prongs extending from one end of said body, each of said prongs being electrically coupled to one of said conductors, the other end of said body having a pair of spaced contacts, each contact being electrically coupled to one of said conductors.

11. A multiple socket strip in accordance with claim 7 wherein said rear cover has a grounding strip which has a portion exposed to each socket hole.

12. A multiple socket strip in accordance with claim 7 including a plug rotatably received in one of said socket holes, said plug having a pair of contact members each contacting one of said conductors in one position of said plug, each plug contact member being J-shaped with the terminal portion being generally parallel to the axis of the plug.

13. A multiple socket strip in accordance with claim 12 wherein each terminal portion of said contact members is supported by a discrete key on said plug, each key having a radially disposed face supported by a land portion of said body between said one hole in one of said grooves, whereby said plug is supported by said body independently of the contact between said contact members and said conductors.

14. A multiple socket strip in accordance with claim 12 including a locking clip on said plug for locking said plug to said body in said one position of said plug.

* * * * *